United States Patent [19]

Van Wagoner

[11] Patent Number: 4,651,494

[45] Date of Patent: Mar. 24, 1987

[54] INSULATION PANEL FOR A ROOFING SYSTEM OR THE LIKE

[76] Inventor: John D. Van Wagoner, 8554 Georgetown Pike, McLean, Va. 22101

[21] Appl. No.: 616,189

[22] Filed: Jun. 1, 1984

[51] Int. Cl.[4] ..... E04B 5/00; B32B 5/32; B32B 11/00

[52] U.S. Cl. ..... 52/593; 52/199; 52/302; 52/309.4; 52/409; 428/314.8; 428/317.7; 428/318.4; 428/489

[58] Field of Search ..... 52/199, 302, 408, 409, 52/410, 15; 428/312.4, 314.8, 314.4, 304.4, 309.9, 317.1, 317.7, 489, 318.4

[56] References Cited

U.S. PATENT DOCUMENTS

| | | | |
|---|---|---|---|
| 3,971,184 | 7/1976 | Van Wagoner | 52/515 |
| 4,274,238 | 6/1981 | O'Riordain | 52/408 |
| 4,368,604 | 1/1983 | Spielall | 52/411 |
| 4,448,830 | 5/1984 | Cogliano . | |
| 4,450,192 | 5/1984 | Cogliano . | |
| 4,464,215 | 8/1984 | Cogliano . | |
| 4,489,531 | 12/1984 | Nelson | 52/408 |
| 4,503,106 | 3/1985 | Cogliano . | |
| 4,503,107 | 3/1985 | Cogliano . | |
| 4,539,262 | 9/1985 | Hurst . | |

FOREIGN PATENT DOCUMENTS

| | | | |
|---|---|---|---|
| 2407308 | 6/1979 | France | 52/408 |

*Primary Examiner*—John E. Murtagh
*Attorney, Agent, or Firm*—Bradford E. Kile

[57] ABSTRACT

A factory assembled, insulation panel for use in a roofing system including an insulation drainage course (42), a moisture vapor retardant barrier (44), and an insulation course (46) of closed-cell, synthetic, polymeric material overlaying said insulating drainage course.

5 Claims, 4 Drawing Figures

INSULATION PANEL FOR A ROOFING SYSTEM OR THE LIKE

RELATED APPLICATION

This application is related to the subject matter of applicant's prior application entitled "Insulated Water Impermeable Roofing System," now U.S. Pat. No. 3,971,184.

BACKGROUND OF THE INVENTION

This invention relates to an improved protected membrane roofing system or the like for a residential or commercial building, deck structure and similar structures. More particularly, this invention relates to an insulation panel for a protected membrane roofing system for insulating the interior of a building from ambient thermal cycling and for insuring water impermeable integrity of the roofing membrane.

The basic concept of a roof is to act in cooperation with wall surfaces to form an enclosed space which may be isolated from an ambient environment and thus may be temperature and humidity regulated in accordance with intended utilization.

A threshold or common denominator of almost all controlled environments is to maintain the enclosure in essentially a water tight or dry condition. Accordingly over the years the roofing industry has attempted to maintain a water tight or water impermeable roof condition by building a water impermeable barrier, in situ, upon a roof substructure or deck. Such a water barrier has typically assumed the configuration of a laminar composite comprising a plurality of bituminous felt layers with intercalated courses of mopped on bituminous composition.

In many previously known installations, bituminous compound arrives at a job site in solid cylinders. The cylinders are melted in a heater and the hot liquid is then carried in buckets to a roof deck where it is mopped onto a previously prepared roof substructure. A roll of bituminous impregnated felt paper is then carried to the roof and unrolled upon the hot bituminous compound which binds the felt to the roof deck. Three or more courses are then built up over the entire roof structure. The job is finished with a layer of topping gravel. The gravel weights down the felt courses and also serves as a shield to minimize ultra-violet degradation of the felt and bituminous membrance.

Although water impermeable roofing membranes, as previously noted, have been widely utilized in the roofing industry substantial disadvantages have been occasioned. In this connection, elevated roof temperatures may vaporize volatile components in the bituminous compound. The compound then tends to harden and crack in a checkered or "allegator" array. Moreoever as the bituminous compound becomes hot during the summer months the overlay course of gravel tends to sink into the membrane. Further, prior roofing systems often developed vapor blisters, splitting or ridging.

The above factors each tended to create water seepage difficulties which ultimately rendered the waterproofing system unsuitable for its intended purpose.

In addition to water impermeability considerations environmental control criteria dictates internal isolation from thermal cycling which takes place at the exterior surface of a roof. More particulalry the exterior surface of a roof may experience temperatures during midsummer as high as 180° Fahrenheit while a winter cold front may drop the temperature to as low as 20° or 30° below zero. The interior surface of the roof, however, should optimally be maintained at a desired interior temperature which typically is 65° to 75° Fahrenheit.

In order to provide thermal protection, an initial practice entailed lining the interior surface of the roof with an insulation composition such as sprayed or layered glass fibers, fiberboard, plastic foams and the like. While such insulation techniques operably reduced thermal cycling problems it severely accentuated the previously outlined difficulties occurring with the felt and bituminous water barrier by isolating the barrier from a relatively stable interior temperature of the building structure. Accordingly, in the past it was not uncommon for roof membranes to require considerable attention and periodic replacement.

One advance was made in the roofing art when it was determined that an insulation course could be installed exteriorly on top of the felt and bituminous water barrier. The exterior insulation provided a building with isolation from thermal gradients and concomitantly physically protected the felt and bituminous waterproofing barrier.

In the above connection, an insulated roof membrance assembly which has attained at least a degree of industry recognition comprises a water barrier of felt and bituminous lamination which is built up, in situ, in a manner as previously discussed. A hot course of bituminous compound is then mopped upon the final layer of felt and generally rectangular panels of polystyrene are laid directly upon the hot bituminous compound. The polystyrene insulating members are abutted against each other and a heavy course of aggregate is applied directly upon the upper surface of the thermal insulating members to hold the members in place and isolate the insulation surface from ultra-violet degradation.

While such a system, as previously noted, has achieved at least a degree of industry recognition and utilization, room for significant improvement remains.

In this regard, an insulated roof membrane assembly as described in the proceeding permits rain water to seep downwardly around lines of panel abutment. The water then migrates beneath the panel and tends to lift or float the panels. In order to obviate this tendency of the insulation to float a substantial amount of gravel needs to be applied directly to the insulation course in order to maintain it in place. In this connection, gravel may be deposited at a rate of 1,000 pounds or more per 100 square feet. The roof deck must therefore be designed to support a considerable amount of weight.

Additionally, rain water which collects in the insulation fissures and beneath the insulation panels strikingly reduces the insulation effectiveness and can even, over time, permeate and degrade the insulation.

The problems suggested in the proceeding are not intended to be exhaustive, but rather are among many which may tend to reduce the effectiveness of prior insulated roofing membrane assemblies. Other noteworthy problems may also exist; however, those presented above should be sufficient to demonstrate that insulated, water impermeable roofing systems appearing in the past will admit to worthwhile improvement.

OBJECTS AND SUMMARY OF THE INVENTION

Objects

It is therefore a general object of the invention to provide an insulation panel for a water impermeable roofing system or the like which will obviate or minimize problems of the type previously described.

It is another object of the invention to provide an insulation panel for a roofing system or the like which is light-weight and is easily handled and installed as well as reduces the load bearing properties upon the underlying roofing deck.

It is yet another object of the invention to provide a novel, insulation panel for a roofing system of the like wherein a tendencey of the insulation to be lifted and floated from underlying water is reduced.

It is still another object of the invention to provide a novel insulation panel for a roofing system wherein insulation properties of the panel are maintained even after long term weather exposure.

It is another object of the invention to provide a novel insulation panel for a roofing system wherein removal of water is facilitated from beneath the insulation panel.

It is a further object of the invention to provide a novel insulation panel for a roofing system or the like wherein the insulating characteristics of an insulation panel are enhanced and prolonged.

It is a related object of the invention to provide a novel insulation panel for a roofing system or the like wherein a tendency for the migration of water vapor into the insulation is minimized.

Brief Summary of the Invention

One preferred embodiment of the invention which is intended to accomplish at least some of the foregoing objects comprises an insulating drainage panel for use in a protected membrane roofing system or the like wherein the panel is a laminated composite of an insulating drainage course, a moisture vapor retardent laminating adhesive course and a closed cell insulation course. The insulating drainage course comprises a generally homogeneous association of expanded polystryene spheres bonded together at points of contact with random voids created throughout the association to render the course both insulating and substantially porous to the passage of water. The insulating drainage course is operable to be placed against an inplace roofing or waterproofing membrane. The moisture vapor retardent laminating adhesive layer overlays the insulating drainage course and is composed of a polymeric emulsion or similar adhesive. The insulation course is composed of a closed cell expanded polystryene or similar insulating material and is adhered to the second course to form a laminated, three layer, composite structure.

The subject composite panel of the instant invention is operably positioned upon a conventional or elasto/-plastic roofing system in an edge-to-edge posture across the building deck with the insulating drainage course positioned against the water impermeable course of the roofing system. A layer of aggregate pavers or similar ballast is deposited on top of the insulation course of the panels to maintain the panels in position and to protect the closed cell insulation course froom solar degradation improve fire resistance and prevent wind blow off. The course of expanded polystryene spheres enables rain water which passes downwardly around the peripheral edges of each panel to migrated to a conventional drain system. Moreover, since water easily passes into and laterally through the first course, the tendency of such water to float the composite panel is somewhat reduced. The initial course also provides a degree of insulation for the underlying water impermeable membrane. The closed cell insulation course, however, has the higher R-rating and provides the primary insulation characteristic of the composite panel structure. The moisture vapor retardent laminating adhesive isolates the primary closed cell insulation from free water and from water vapor which raises upwardly from both rainwater on the deck and water vapor from within the building structure which over time can migrate through the roofing membrane. The relative high degree of vapor impermeably of the intermediate laminating adhesive layer or course of the instant panel, as compared with the peripheral joints or gaps around the panels, insures that water vapor escapes into the atmosphere around the panels and not through them. This prolongs the life of the insulation course and enhances its insulating characteristics.

THE DRAWINGS

Other objects and advantages of the present invention will become apparent from the following detailed description of a preferred embodiments taken in conjunction with the accompanying drawings, wherein.

Figure 3:
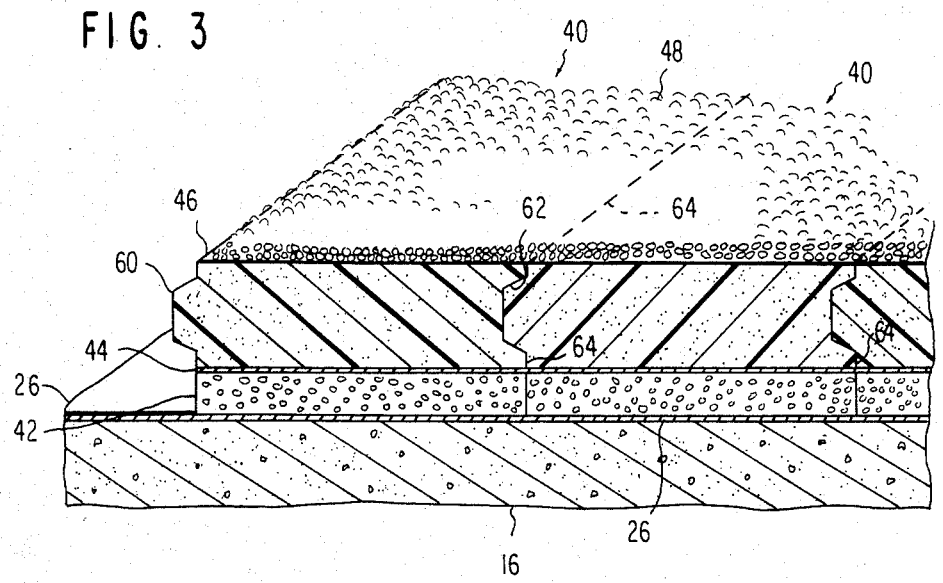
Figure 4:
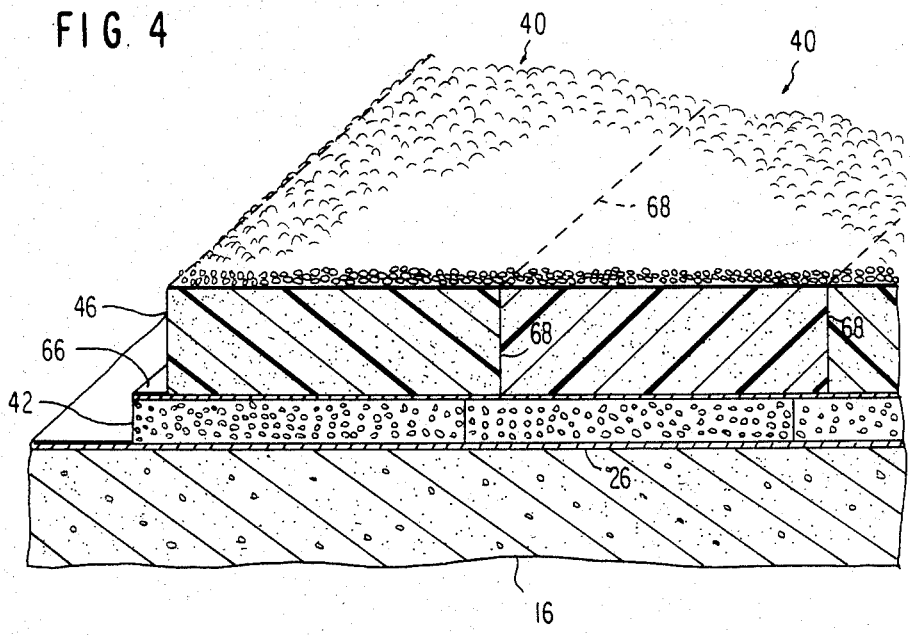

FIG. 3 disclosed a cross-sectional detailed view of a pair of insulation, water impermeable roofing panels positioned upon a roofing deck and including a tongue and groove joint between juxtaposed panels; and FIG. 4 comprises a cross-sectional detailed view of a pair of insulation water impermeable roofing panels positioned upon a roofing deck and including an offset joint between juxtaposed panels.

DETAILED DESCRIPTION

Context of the Invention

Figure 1:
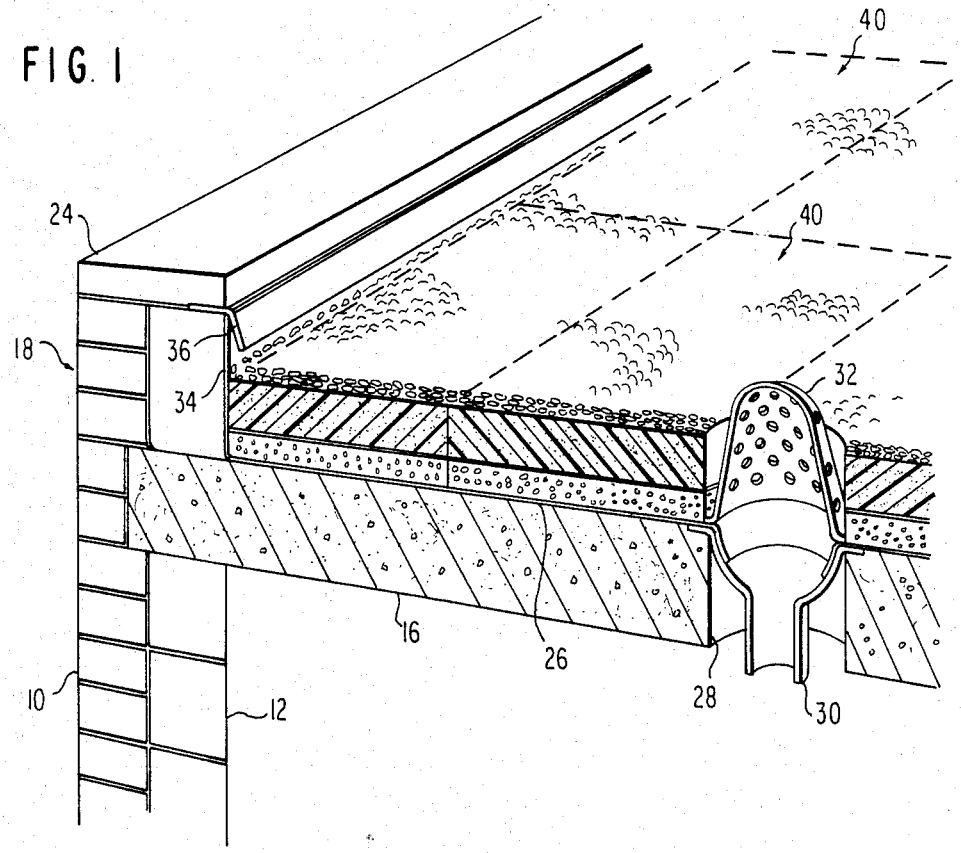
FIG. 1 is an axonometric view of a building or enclosure including a roof deck with an array of insulation panels applied to an upper surface of the roofing deck.
Figure 2:
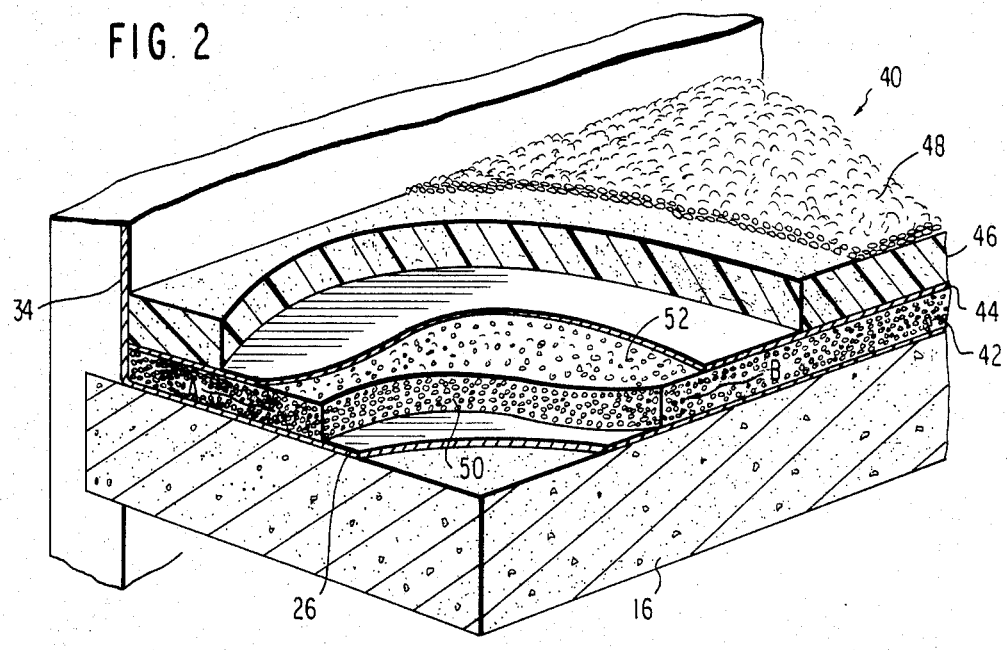
FIG. 2 is an axonometric view of an individual insulation panel which has been broken away to reveal details of each course of the subject insulation panel.

Referring now particularly to FIGS. 1 and 2, axonometric views can be seen of a general operative environment of the invention. In this regard, a wall is shown composed of a conventional brick 10 and block 12 construction and a generally horizontally extending expanse of concrete 16 which is operable to form a structural roof and/or deck or the like. Structural roof deck could be constructed of steel, wood, or other acceptable materials. A brick and block extension 18 is formed around the periphery of the roof or deck as an extension of the wall and terminates by a conventional capping of tin or copper 24 or a similar to acceptable construction method.

A water impermeable membrane 26 is laid up on the roof or deck surface by a conventional technique such as multiple applications of felt paper and hot melt bituminous compound as outlined above or an elasto/plastic membrane. The roof or deck surface 27, while being generally flat, can be sloped to a degree toward drain openings 28 at various locations along the surface and a generally vertical drain pipe 30 is positioned within the openings 28. Each drain pipe is typically fitted at an upper end with a drain cover 32 having a plurality of apertures suitable to permit water to enter into the drain while isolating the drain from particulate debris. The water impermeable membrane 26 is extended upwardly along the periphery of the roofing system as at 34 and a downwardly extending flashing 36 covers an upper end of the membrane 34. Accordingly, water which falls on the roof surface, such as by rain, is normally collected upon the generally horizontal deck surface 27 and migrates by gravity toward the vertical drains 30 in a manner conventional in the roofing industry.

The structure depicted in FIG. 1 is intended to be illustrative and not exhaustive and serves to identify at least one area in the building industry where a water and vapor membrane such as 26 is utilized to isolate the interior of a structure from moisture. Such membranes, or their equivalent, may also be affixed to other portions of the building such as around the foundations or below grade wall surfaces.

Insulated, Factory Assembled Panel

In order to isolate the water impermeable membrane 26 from ultra-violet degradation, thermal cycling and the impingement of sharp objects and the like, the membrane is protected by a plurality of factory-assembled, insulation panels 40 in accordance with the subject invention.

Referring specifically to FIG. 2, each panel 40 is composed of a lamination of an insulating drainage course 42, a moisture vapor retardent laminating adhesive barrier 44 and a closed cell insulation course 46. An overlying course of gravel, particulate matter or an array of pavers 48 is laid on top of the panels 40 to provide weight, isolate the insulation course 46 from ultra-violet degradation and add fire resistance.

Turning specifically to the insulating drainage course 42, it is composed of a generally homogeneous association of expanded synthetic polymeric spheres bonded together at points of contact with random voids created throughout the association. These voids render the insulating drainage course 42 substantially porous to the passage of water. Accordingly, water which penetrates to the membrane 26 is free to migrate laterally through the insulation and drainage course such as depicted by directional arrows A and B in FIG. 2 to a roofing drain. In a similar manner during a rain storm or the like water can rise and collect within the voids as it drains off thus reducing a tendency of the rain water to float the panels.

The insulating drainage course 42 is preferably composed of a plurality of expanded or extruded polystyrene spheres or beads 50 which are lightly bonded or fused together at random touching surface locations. Sphere fusing can be achieved by a steam fusion technique in a mold or bonding can be accomplished with a light coating of a latex bituminous emulsion or similar adhesive. The beads are bonded together as spheres as opposed to being deformed into a solid mass. This relatively open formation creates voids 52 between adjacent spheres in a random three-dimensional array. The voids permit water to migrate throughout the member 42 as noted above.

The fusing or bonding of the lightly touching spheres creates an essentially homogeneous association of expanded polystyrene beads which form a resilient insulation member. This degree of resilience provides a form of protection for the underlying water impermeable vapor membrane 26 from the impingement of sharp objects and the like which might otherwise pierce the membrane.

The size of the spheres may be varied with different panels depending upon whether maximum drainage or insulation is desired. Moreover, the size of the spheres within any panel may be random. However, it has been determined that optimum results of insulation, protection and drainage are achieved when the panel is fashioned with spheres having a diameter of from 0.317 centimeters to 1.27 centimeters.

Further while a spherical configuration of the beads is preferred, other three dimensional shapes are contemplated by the subject invention such as cubes, solid rectangles or other polyhedron configurations and the like as desired. In addition, materials other than polystyrene may be used in practicing the invention such as polyisocyanurate, polyurethane and the like.

The moisture vapor retardent barrier 44 overlays a surface of the insulating drainage course 42 in a position operably remote from the roofing membrane 26 or the like and is composed of a self-adhering polymeric emulsion. In this connection, materials which have been found to exhibit particular utility for the instant invention includes petroleum based, bituminous resin, plasticized with high molecular weight polymeric additives or unvulcanized synthetic rubber, neoprene or butyl rubber compositions, polyurethane elastomeric materials, polysulfide elastomeric materials, silicone elastomeric materials, acrylic elastomeric materials and polyethylene or polyvinyl chloride compositions. The most preferred composition for the water and vapor barrier 44 comprises a petroleum based, bituminous resin, plasticized with high molecular weight polymer additives or unvulcanized synthetic rubber.

The insulation course 46 is composed of a closed cell insulating material. Such an insulation material may be selected from a polystyrene family of expanded foams, polyurethane or polyvinyl flouride family of foams, foam glass or glass beads, insulating concrete or bituminous blocks. While it is anticipated that the foregoing materials are operative, it has been found that polystryene expanded foam is the most preferred and possesses markedly superior performance properties, when used as described herein, to other known materials.

Turning to FIG. 3, there will be seen a factory assembled, insulation panel for use in a roofing system or the like in accordance with the instant invention wherein an outwardly extending tongue 60 is fashioned along a lateral surface of the closed cell insulation course 46. A corresponding groove or recess 62 is fashioned along opposing peripheral sides of the insulation course 46 of the generally rectangular panel and operably cooperates with a tongue portion in a next adjacent panel to form a tongue and groove mating system whereby a plurality of panels 40 may be operably joined into a uniform roofing structure or the like.

Although adjacent panels are unified by the tongue and groove arrangement as depicted in FIG. 3, a peripheral seam or gap 64 extends around each of the independent panels 40 and thus rain water and the like which impinges upon the roofing surface is permitted to migrate through the seams and into the insulating drainage course 42. Such surface rain water is then free to migrate laterally to a conventional roofing drain as indicated above in connection with FIGS. 1 and 2. In a converse manner, it has been found that in many building constructions, particularly where wooden roofing decks or metal decks having bolted connections or the like are utilized, interior building vapor pressure exists which drives vapor upwardly and outwardly from the building. Such vapor which penetrates the roofing deck 16 and permeates through weak spots in the water impermeable membrane 26 is then free to migrate laterally within the insulation and drainage course 42. Such a lateral migration, in fact, is induced by the vapor retardent layer 44 until the moisture reaches a seam 64. The vapor then progress outwardly to the atmosphere without penetrating and degrading the insulation course 46.

In addition to the tongue and groove arrangement for unifying individual panels 40 as depicted in FIG. 3, FIG. 4 discloses an offset arrangement for laying up a unified roofing system from a plurality of the instant panels. A recess will be formed along opposing adjacent surfaces of the panel such that the individual panels 40 may be unified with an overlap such as depicted in FIG. 4. In a manner identical to that discussed with regard to the tongue and groove arrangement, each panel permits surface water to penetrate into the insulation and drainage course 42 and to be conveyed away in a conventional drainage system. At the same time water vapor is permitted to escape outwardly without penetrating and degrading the insulation course 46.

Summary of Major Advantages of the Invention

In describing a factory assembled, insulation panel for use in a roofing system or the like in accordance with preferred embodiments of the invention, those skilled in the art will recognize several advantages which singularly distinguish the subject invention from the heretofore known prior art. A particular advantage of the subject invention is the provision of the factory assembled roofing panel composite wherein rain water drainage capability is maintained while an insulation course is isolated from degradation from standing roofing water and vapor moisture. The adhesive course 44 serves a dual function of bonding the composite into a unitary member and serving as an additional vapor retarder, which greatly enhances the thermal insulating characteristics of the primary insulation course 46 by preventing water vapor from permeating into the insulation. This combination of the vapor retarding course 44 and the underlying insulation and drainage course 42 effectively isolates the closed cell insulation course 46 from both standing water and moisture flowing outwardly from the roofing assembly.

The subject insulating panels, which are factory assembled and combined on the job site into a roofing system, facilitate installation and the inter-locking edges permit the system to be unified into a homogeneous structure and eliminates the need for excessive aggregate being piled on top of the panels to maintain the panels in place. Moreover, the insulating course 42 which rests upon the water impermeable membrane 26 permits free standing water to be effectively drained into a conventional drainage system thus in addition minimizing the tendency of rain water and the like to cause the system to float or buckle.

In describing the invention, reference has been made to preferred embodiments. Those skilled in the art, however, and familiar with the disclosure of the subject invention, may recognize additions, deletions, modification, substitutions and/or other changes which will fall within the purview of the invention as defined in the following claims.

I claim:

1. A factory assembled, insulation panel for use in a roofing system or the like to insulate the interior of a building from ambient thermal cycling and for insuring water impermeable integrity of the building, said insulation panel being laminated and comprising:

an insulating drainage course operable to be placed against a waterproofing roof membrane or the like, said insulating drainage course comprising, a generally homogeneous association of expanded polystyrene spheres fixed together at points of contact with random voids created throughout the association to render it both insulating and substantially porous to the passage of water, and said expanded polystyrene spheres of said insulating drainage course being coated with an outer film of latex bituminous emulsion, the coated spheres being resistant to the penetration of water interiorly within the spheres and concomitantly the latex bituminous emulsion being a waterproofing adhesive such that the spheres are fixed together at contact points to isolate the expanded polystyrene spheres from penetration by water and moisture and to adhere the spheres in a generally homogeneous association which is porous to the passage of water;

an insulation course of closed cell synthetic polymeric material overlaying said insulating drainage course, said insulation course serving to thermally isolate a building and the waterproofing roof membrane from ambient thermal cycling; and a water and vapor barrier course co-extensively extending between said insulating drainage course and being composed of a self adhering polymeric emulsion such that said water and vapor barrier course protects said insulation course from penetration of water and water vapor and concomitantly adheres said insulation course to said insulation drainage course, wherein a factory assembled, insulation panel may be combined with other similar panels to form a roofing system or the like with an insulating and drainage course being operable to permit water which reaches a waterproofing membrane to migrate through the insulating drainage course to a drain while the insulation course is protected from water and vapor moisture by the water and vapor barrier course coextensively extending between said insulation drainage course and said insulation course.

2. A factory assembled, insulation panel for use in a roofing system or the like as defined in claim 1 wherein:

said polystyrene spheres comprise a uniformly random assembly of expanded spheres having a diameter of from 0.317 centimeters to 1.27 centimeters.

3. A factory assembled, insulation panel for use in a roofing system or the like as defined in claim 1 wherein:

said insulation course of closed cell synthetic polymeric material is composed of polystryene expanded beads.

4. A factory assembled, insulation panel for use in a roofing system or the like as defined in claim 1 wherein:

said factory assembled, insulation panel is generally rectangular and an outwardly extending tongue is formed an adjacent lateral surface of said insulation course of closed cell polystryene material and a corresponding groove is inwardly fashioned on the other adjacent lateral surface of said insulation course of closed cell polystryene material such that a series of said factory assembled insulation panels may be fitted together and interlocked with tongue and groove interaction to form a unified roofing system or the like.

5. A factor assembled, insulation panel for use in a roofing system or the like as defined in claim 1 wherein: said factory assembled, insulation panel is generally rectangular and said insulation and drainage course is offset with respect to said insulation course of closed cell material on an adjacent lateral surface thus forming an extension on the adjacent lateral surface at the insulating drainage course level of the panel and a corresponding recess on the adjacent lateral surface at the insulating and drainage course level such that a series of said factory assembled, insulation panels may be fitted together and interlocked to form a unified roofing system or the like.

* * * * *